US006997133B1

(12) United States Patent
Song et al.

(10) Patent No.: US 6,997,133 B1
(45) Date of Patent: Feb. 14, 2006

(54) INFLATABLE FLOATING DEVICE

(76) Inventors: Rong-Jyh Song, 8F-1, No. 102, Sec. 2 Roosevelt Rd., Taipei (TW); Tsung-Ping Yen, 8F-1, No. 102 Sec. 2, Roosevelt Road, Taipei (TW)

( * ) Notice: Subject to any disclaimer, the term of this patent is extended or adjusted under 35 U.S.C. 154(b) by 0 days.

(21) Appl. No.: 10/937,414

(22) Filed: Sep. 10, 2004

(51) Int. Cl.
*B63B 7/00* (2006.01)

(52) U.S. Cl. ..... 114/345; 441/66

(58) Field of Classification Search ..... 114/315, 114/345; 441/65, 66
See application file for complete search history.

(56) References Cited

U.S. PATENT DOCUMENTS 4,606,728 A * 8/1986 Simpson ..... 441/66
4,942,839 A * 7/1990 Chuan ..... 114/345
5,713,773 A * 2/1998 Churchill ..... 441/66
6,182,594 B1 * 2/2001 Wilson ..... 114/253

* cited by examiner

*Primary Examiner*—Stephen Avila

(74) *Attorney, Agent, or Firm*—Foley & Lardner LLP

(57) ABSTRACT

An inflatable floating device has an inflatable body which includes front and rear ends, a hand grip disposed on a top side of the inflatable body adjacent to the front end, a rudder portion projecting downwardly from a bottom side of the inflatable body, a counterweight disposed in the inflatable body adjacent to the bottom side, and two leg support parts disposed on the top side of the inflatable body. The bottom side of the inflatable body is convexed downwardly between the front and rear ends.

12 Claims, 7 Drawing Sheets

INFLATABLE FLOATING DEVICE

BACKGROUND OF THE INVENTION

1. Field of the Invention

The invention relates to a floating device, more particularly to an inflatable floating device.

2. Description of the Related Art

Many water sports involve devices that are driven by a motor to be propelled on the water surface. If the motor malfunctions or is removed from the device, the user has to use his or her hands and feet, or an oar, to advance the device on the water surface, which may be laborious. In the case where the device is an inflatable apparatus, this is not provided with an auxiliary part that may be connected directly to a body of the device so as to enable advancement of the device and the dispensing with any direct or indirect use of the motor. Moreover, the conventional inflatable floating device is not provided with a counterweight and a rudder portion so that it cannot float stably on the water surface and its advancing direction cannot be controlled.

SUMMARY OF THE INVENTION

Therefore, the main object of the present invention is to provide an inflatable floating device which has a front part that can be alternately moved downwardly and upwardly by a rider for advancement in water.

Another object of the present invention is to provide an inflatable floating device that can float stably on the water surface, even when the user is getting on or off the floating device.

A still another object of the present invention is to provide an inflatable floating device that is stable when it advances in the water.

According to this invention, an inflatable floating device comprises an inflatable body which includes front and rear ends, a hand grip disposed on a top side of the inflatable body adjacent to the front end, a rudder portion projecting downwardly from a bottom side of the inflatable body, a counterweight disposed in the inflatable body adjacent to the bottom side, and two leg support parts disposed on the top side of the inflatable body. The bottom side of the inflatable body is convexed downwardly between the front and rear ends.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
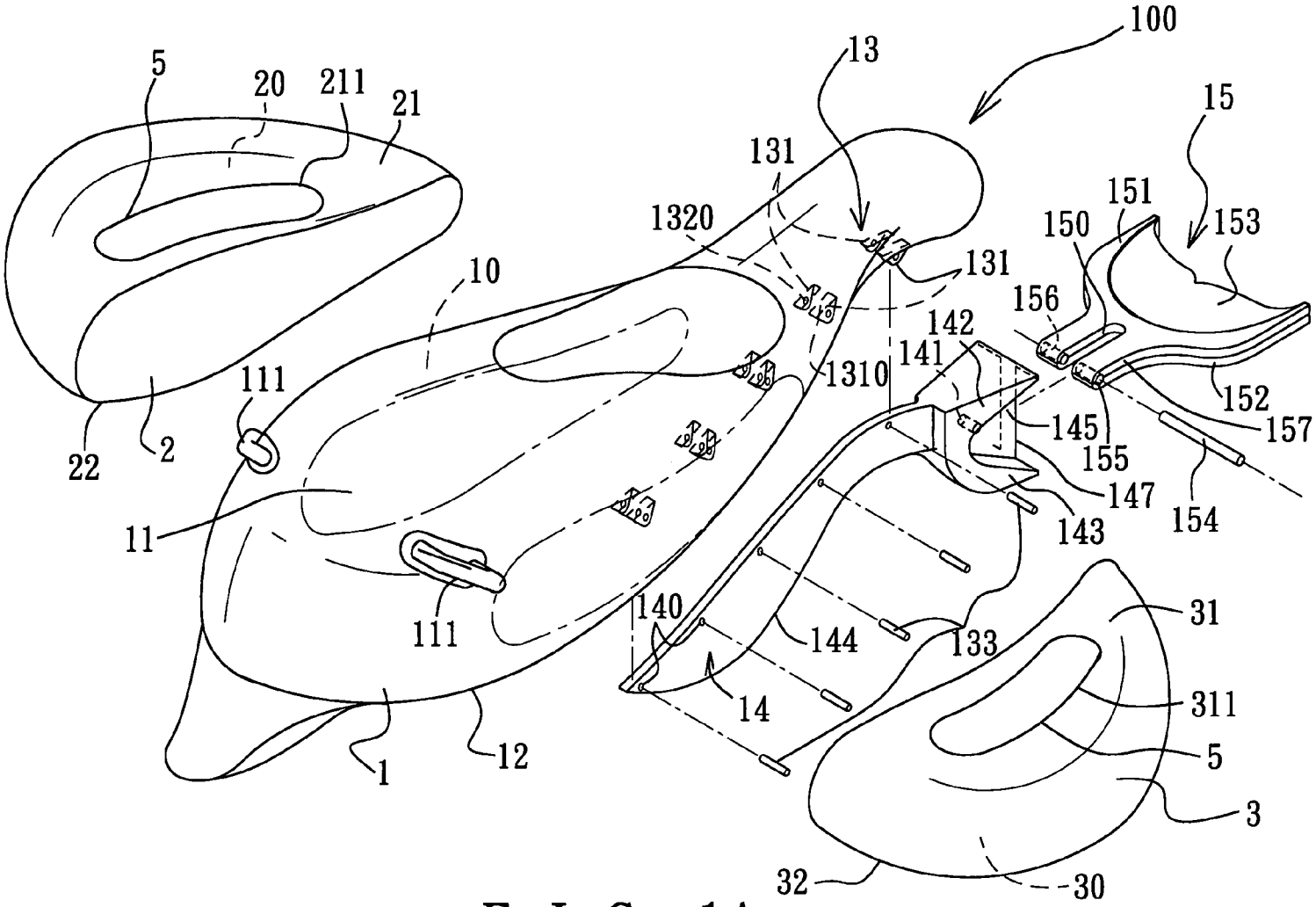
FIG. 1A is an exploded perspective view of the first preferred embodiment of an inflatable floating device according to the present invention.
Figure 1B:
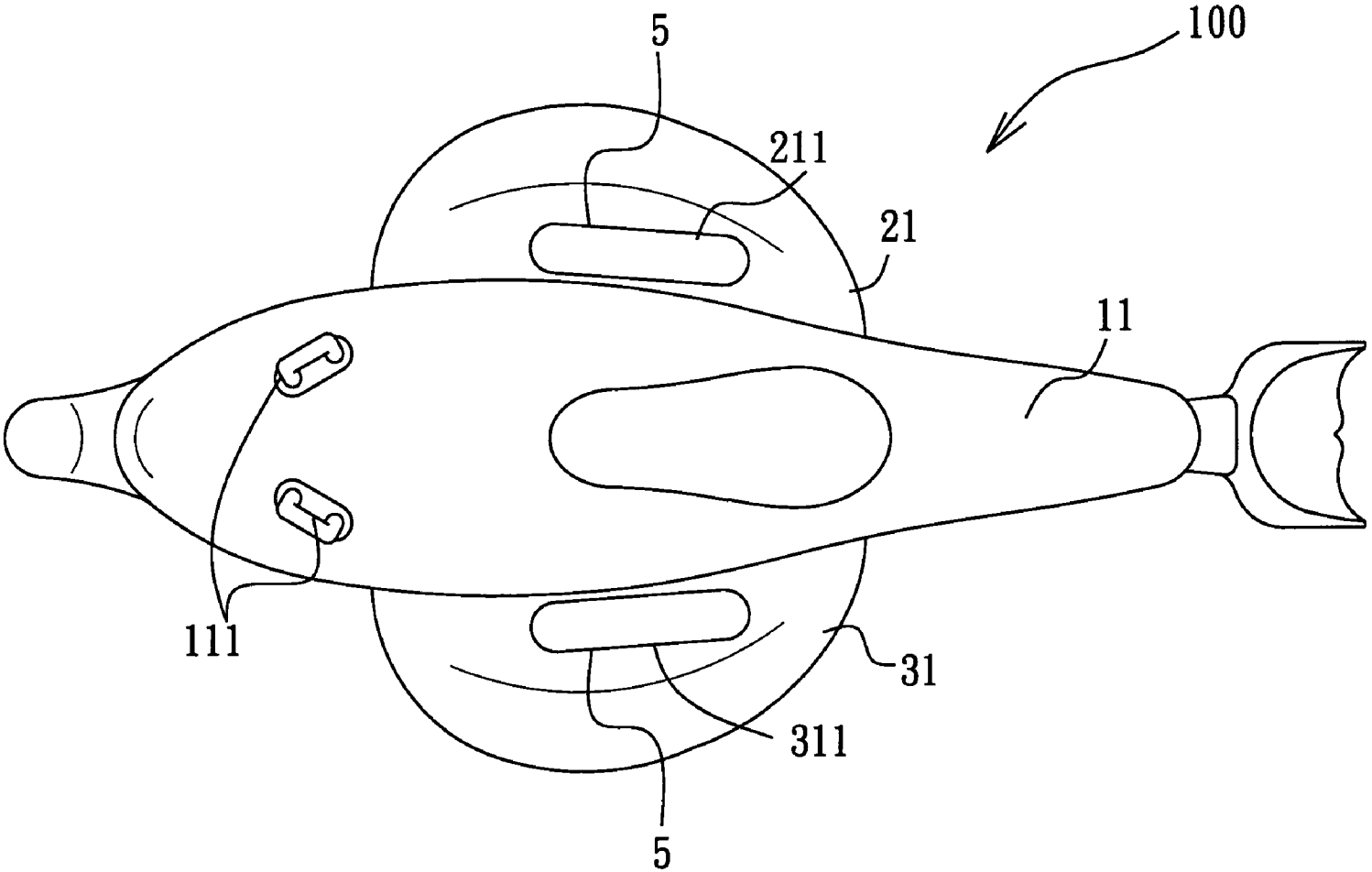
FIG. 1B is a schematic top view of the first preferred embodiment in an assembled state.
Figure 2:
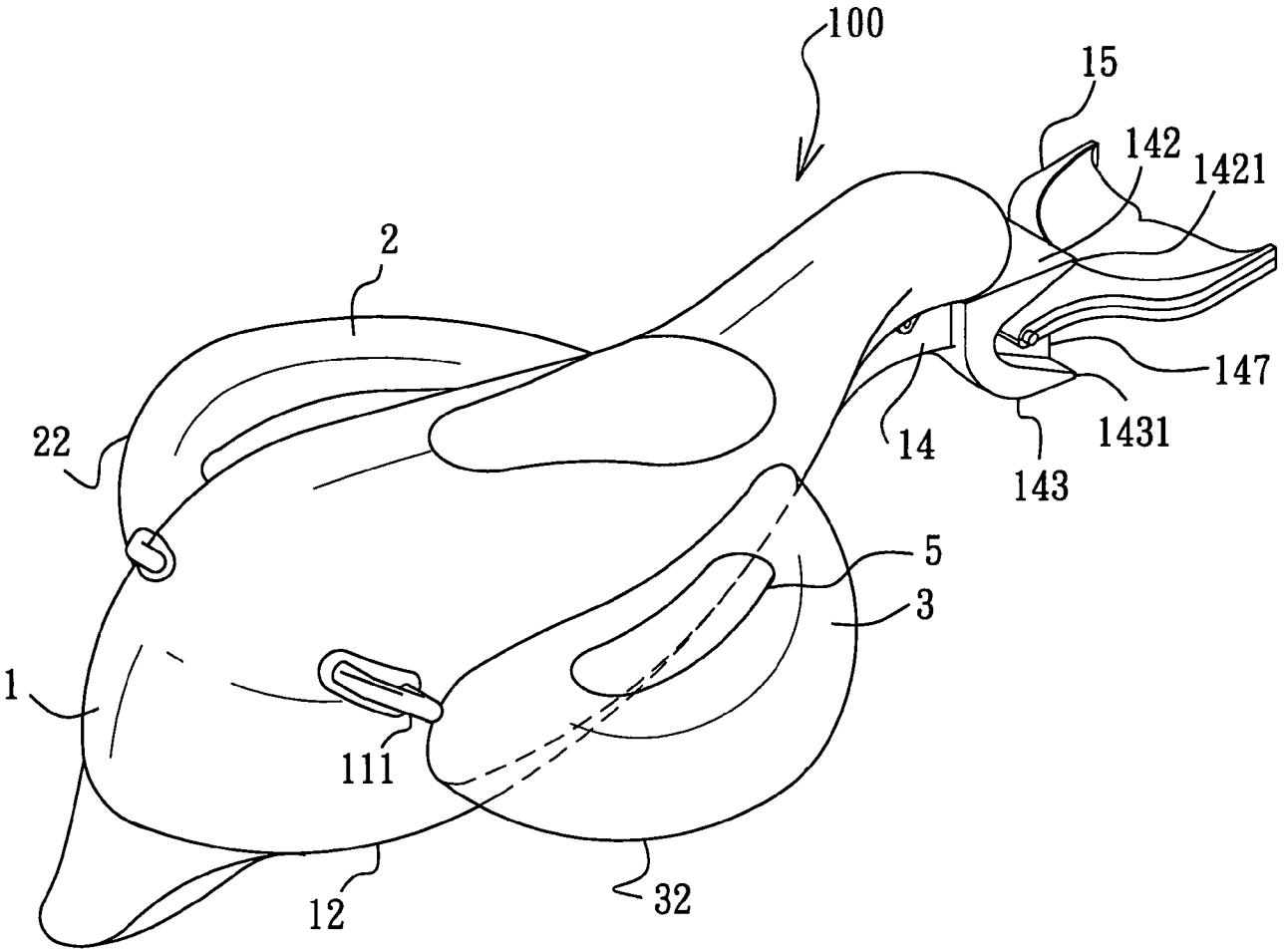
FIG. 2 is a perspective view of the first preferred embodiment in an assembled state.

Before the present invention is described in greater detail, it should be noted that like elements are denoted by the same reference numerals throughout the disclosure.

Referring to FIGS. 1A to 7, the first preferred embodiment of an inflatable floating device according to the present invention is shown to include an inflatable body 100 that resembles a dolphin. The inflatable body 100 includes front and rear ends, two spaced-apart hand grips 111, a rudder portion 14, two counterweights 23, 33, and two leg support parts 5. Preferably, the inflatable body 100 has a bottom side which is convexed downwardly between the front and rear ends, and the width of the inflatable body 100 is reduced toward the front end from a portion of the inflatable body 100 between the front and rear ends. This arrangement facilitates downward movement of the front end of the inflatable body 100 into water because of the decreased contact surface area between the front end of the inflatable body 100 and the water, and results in reduction of the resistance of water against the downward movement of the front end of the inflatable body 100.

Figure 4:
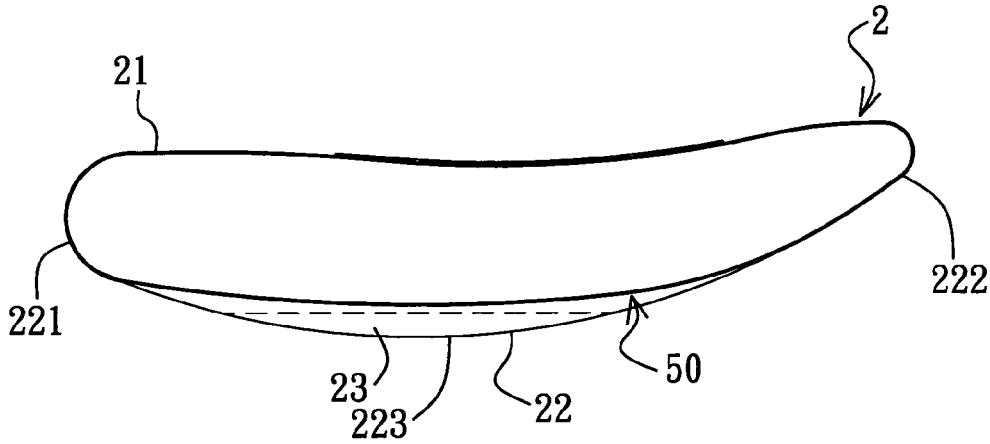
FIG. 4 is a schematic side view of the first preferred embodiment but with second and third inflatable portions being omitted to illustrate only a first inflatable portion.
Figure 5:
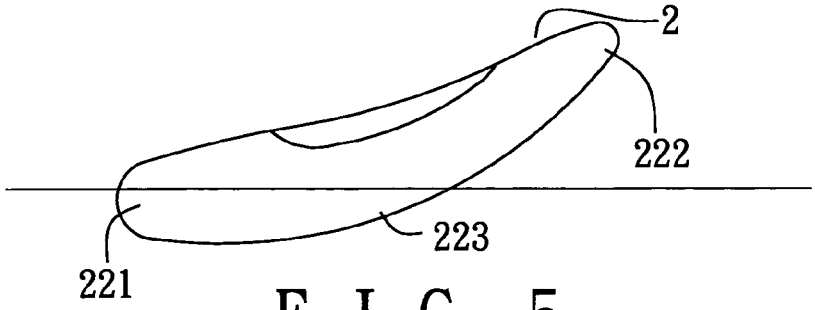
FIG. 5 is a view similar to FIG. 4, but illustrating the first inflatable portion moved downwardly.
Figure 6:
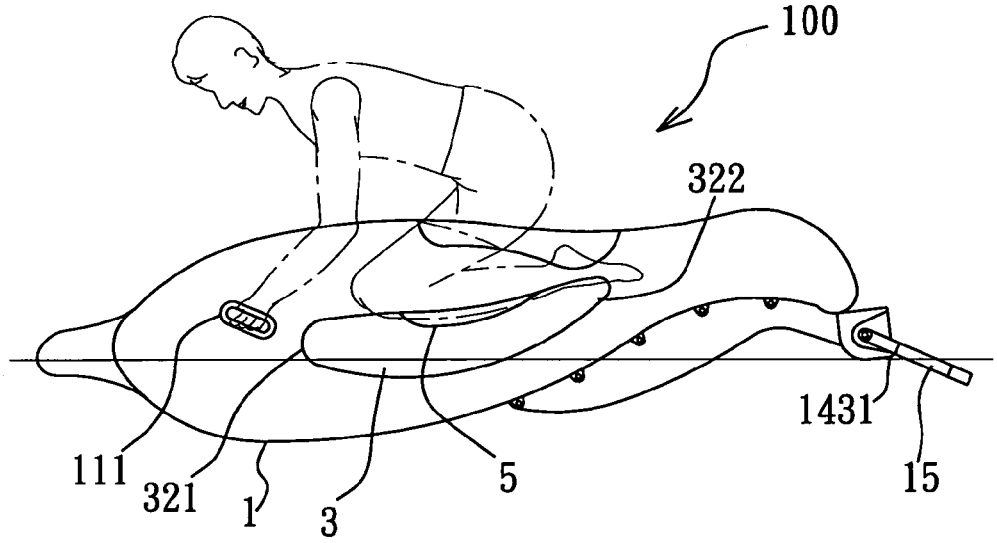
FIG. 6 is a schematic side view of the first preferred embodiment, illustrating how a tail wing pivots downwardly when a rider exercises on an inflatable body.

In this embodiment, the inflatable body 100 includes first, second and third inflatable portions 2, 3, 1. The first and second inflatable portions 2, 3 are connected respectively to two opposite sides of the third inflatable portion 1, and look like the fins of the dolphin. The first, second and third inflatable portions 2, 3, 1 have respective first, second and third air chambers 20, 30, 10, respective first, second and third top walls 21, 31, 11, and respective first, second and third bottom walls 22, 32, 12. As best shown in FIG. 4, the first bottom wall 22 has a front head portion 221, a rear tail portion 222, and a middle portion 223 between the front head and rear tail portions 221, 222. The first bottom wall 22 extends upwardly and curvedly from the middle portion 223 to the front head and rear tail portions 221, 222.

The second inflatable portion 3 is a mirror image of the first inflatable portion 2.

Figure 3:
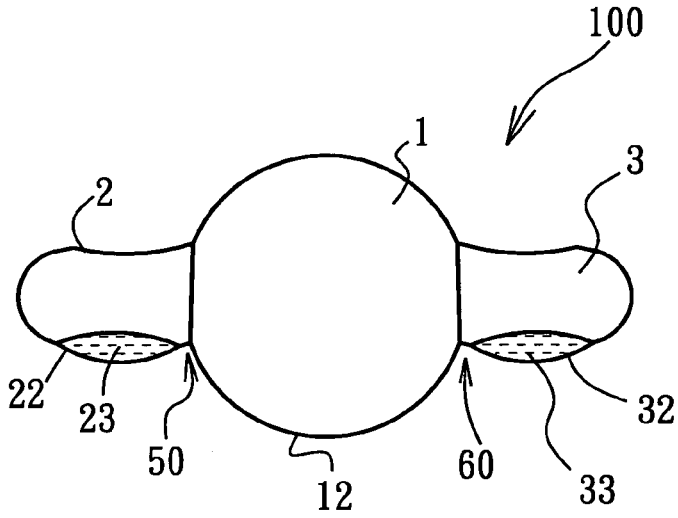
FIG. 3 is a schematic front view of the first preferred embodiment.
Figure 7:
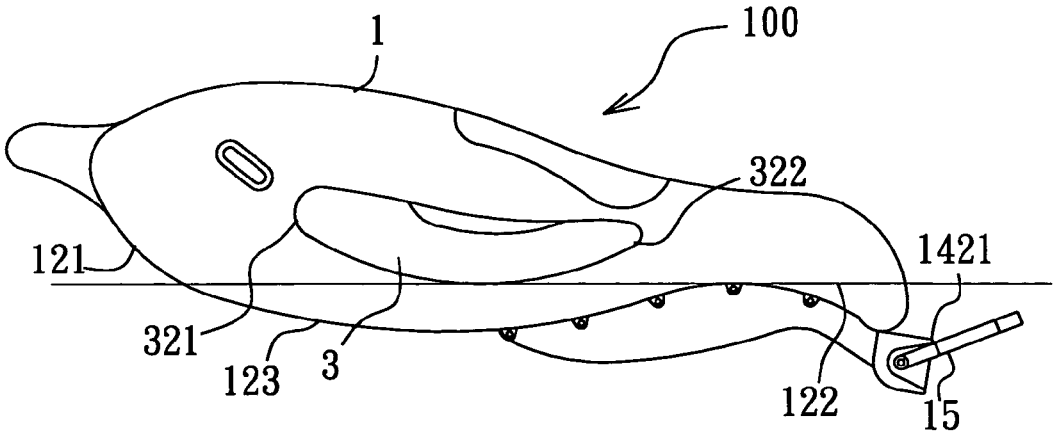
FIG. 7 is a view similar to FIG. 6, but with the tail wing being moved upwardly.

As best shown in FIG. 7, the third inflatable portion 1 also has a front head portion 121, a rear tail portion 122, and a middle portion 123 between the front head and rear tail portions 121, 122. The third inflatable portion 1 projects forwardly from the first and second front head portions 221 (see FIG. 5), 321, and projects rearwardly from the first and second rear tail portions 222 (see FIG. 5), 322. As shown in FIG. 3, indentations 50, 60 are defined between the third bottom wall 12 and the first bottom wall 22 and between the third bottom wall 12 and the second bottom wall 32. The indentations 50, 60 extend substantially in a front-to-rear direction.

The hand grips 111 are connected to the top wall 11 of the third inflatable portion 1 adjacent to the front head portion 121 of the third inflatable portion 1.

A fastening unit 13 is disposed on the third bottom wall 12. In this embodiment, the fastening unit 13 includes five fasteners, each of which includes two spaced-apart lug portions 131, and five insert pins 133. Each of the lug portions 131 has a top end portion 1310 heat sealed to the third bottom wall 12, and a positioning hole 1320 formed in the respective lug portion 131 for extension of the respective insert pin 133 therethrough.

The rudder portion 14 is connected to the third bottom wall 12 of the third inflatable portion 1, and includes a rudder plate 144 that extends downwardly from the middle portion 123 and the rear tail portion 122 along the front-to-rear direction, and a tail wing l5 pivotally connected to a rear end of the rudder plate 144. The rudder plate 144 has five spaced-apart through holes 140 formed at a top portion thereof. The rudder plate 144 is disposed between the lug portions 131 of the fasteners, and each of the insert pins 133 is passed through one of the positioning holes 1320, the respective through hole 140, and out of the other one of the positioning holes 1320 in a direction transverse to the front-to-rear direction so as to connect the top portion of the rudder plate 144 to the lug portions 131, thereby positioning the rudder plate 144 to the third bottom wall 12 of the third inflatable portion 1.

When the third inflatable portion 1 is inflated, the rudder plate 144 projects downwardly from the third bottom wall 12. The rudder portion 14 is provided to ensure a predetermined advancing direction of the inflatable body 100 when the inflatable body l00 moves on the water surface. While the rudder portion 14 in this embodiment is formed by connecting the rudder plate 144 to the third inflatable portion 1 in the manner described above, any other suitable connecting method may be used.

The rudder plate 144 of the rudder portion 14 further has a connecting member 145 formed at the rear end thereof. The connecting member 145 is substantially U-shaped, and has spaced-apart upper and lower arms 142, 143, and a pivot plate 147 extending between and bridging the upper and lower arms 142, 143. The upper and lower arms 142, 143 respectively have upper and lower rear edges 1421, 1431. The pivot plate 147 is formed with a first pivot hole 141.

The tail wing 15 of the rudder portion 14 has a bifurcated front pivot portion 157 extending in an area between the upper and lower arms 142, 143 and connected pivotally to the pivot plate 147. The bifurcated front pivot portion 157 defines an elongate groove 150 to engage the pivot plate 147, and has second pivot holes 155, 156 that extend transverse to the front-to-rear direction. A pivot shaft 154 passes through the second pivot hole 155, the first pivot hole 141 and the second pivot hole 156, thereby securing pivotally the tail wing 15 to the rudder portion 14. At this time, the front pivot portion 157 is swingable upwardly and downwardly between the upper and lower arms 142, 143, and is able to contact the upper and lower rear edges 1421, 1431 which limit the movement of the front pivot portion 157.

The tail wing 15 further has upper and lower framing parts 151, 152 connected to the front pivot portion 157, and a flexible thin section 153 clamped between the upper and lower framing parts 151, 152. In this embodiment, the upper and lower framing parts 151, 152 are made of plastic steel by injection molding to enhance the mechanical strength of the tail wing 15, while the thin section 153 is made of rubber so as to reduce an overall weight of the tail wing 15. The thin section 153 is cut so as to conform to the shape of a dolphin's tail. In an alternative embodiment, the upper and lower framing parts 151, 152 and the thin section 153 are integrally formed.

The first and second leg support parts 5 are disposed respectively on the first and second top walls 21, 31 of the first and second inflatable portions 2, 3, and are provided respectively with anti-slip members 211, 311. The first and second leg support parts 5 are large enough to permit a rider to kneel thereon.

To enhance the stability of the inflatable floating device of the present invention on the water, a counterweight 23, 33 is disposed in each of the first and second inflatable portions 2, 3 adjacent to the first or second bottom wall 21, 31 so as to prevent the inflatable body 100 from being flipped over. The counterweight 23, 33 in each of the first and second inflatable portions 2, 3 may be realized by water filling a sealed space in the inflatable body 100 prior to inflation of air into the first, second and third inflatable portions 2, 3, 1. Other counterweight element, such as sand, lead pieces, etc., may be used in place of water. Since the first, second and third inflatable portions 2, 3, 1 are individually inflated and thus have separate air chambers 20, 30, 10, they can enhance safety while a user is performing a water activity because even if one of the inflatable portions 2, 3, 1 has an air leakage, the user can still stay afloat on the water surface. However, if cost is a consideration, the first, second and third inflatable portions 2, 3, 1 may be formed integrally so that their air chambers 20, 30, 10 are in spatial communication.

Referring again to FIGS. 5 and 6, during exercise, the rider kneels on the leg support parts 5 with his hands holding the hand grips 111. When the rider leans his body forward and downward, then again kneels upright in an alternating manner, the front end of the inflatable body 100 is pressed downwardly intermittently. As the inflatable body 100 is pressed downwardly, the front head portions 221, 321, 121 of the first, second and third inflatable portions 2, 3, 1 propel water rearwardly, thereby forwardly advancing the inflatable body 100. Due to the presence of the indentations 50 and 60 (see FIG. 3), water can be efficiently collected and propelled rearwardly, thus increasing the speed of the advancement. Through this structural design, the inflatable floating device of the present invention can achieve a speed of one meter per second, which has been demonstrated through tests.

Referring back to FIG. 4, because the first bottom wall 22 is convexed downwardly in the middle portion 223, the resistance of water against the downward movement of the front head portion 221 and of the rear tail portion 222 can be significantly reduced when the front head portion 221 and the rear tail portion 222 of the first inflatable portion 2 are moved upward and downward alternately on the water surface. The same effect is achieved by the second inflatable portion 3 which is a mirror image of the first inflatable portion 2 as described above.

Referring once again to FIG. 6, when the front end of the inflatable body 100 is pressed downwardly, the rear end of the inflatable body 100 moves upwardly. At this juncture, the tail wing 15 pivots downwardly, and abuts against the lower rear edge 1431.

Referring back to FIG. 7, when the front end of the inflatable body 100 moves upwardly, the rear end of the inflatable body 100 moves downwardly, and the tail wing 15 pivots upwardly and abuts against the upper rear edge 1421. The upward and downward movement of the tail wing 15 can assist in advancing the inflatable body 100.

Figure 8:
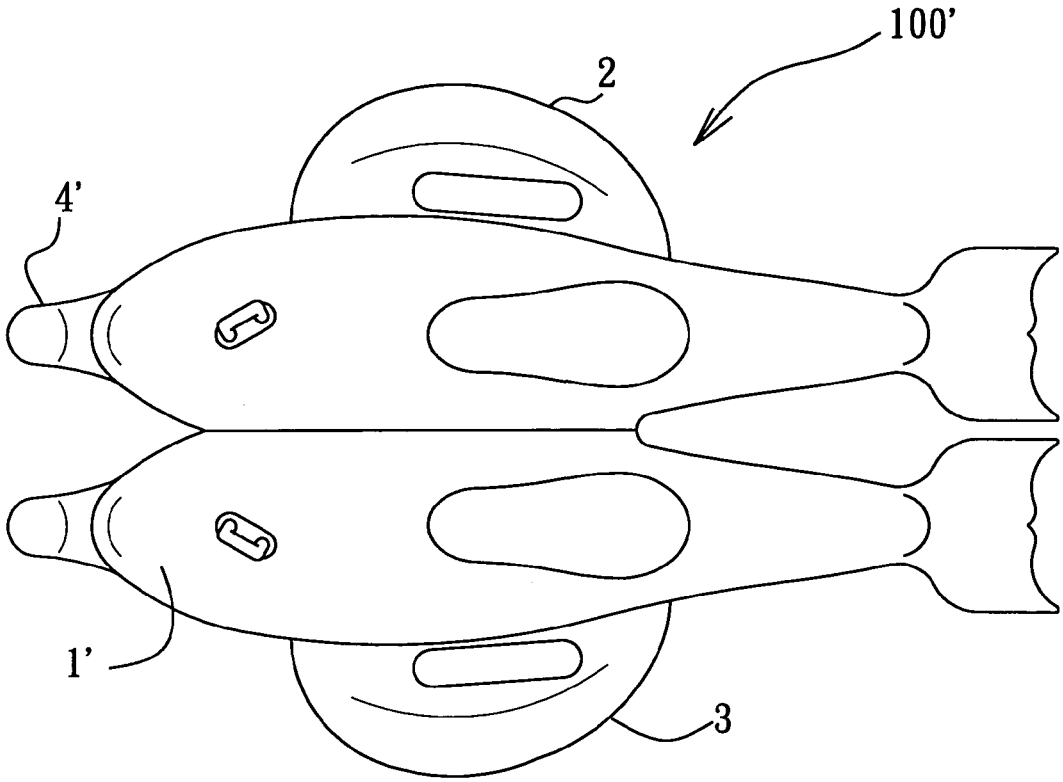
FIG. 8 is a schematic top view of the second preferred embodiment of an inflatable floating device according to the present invention.
Figure 9:
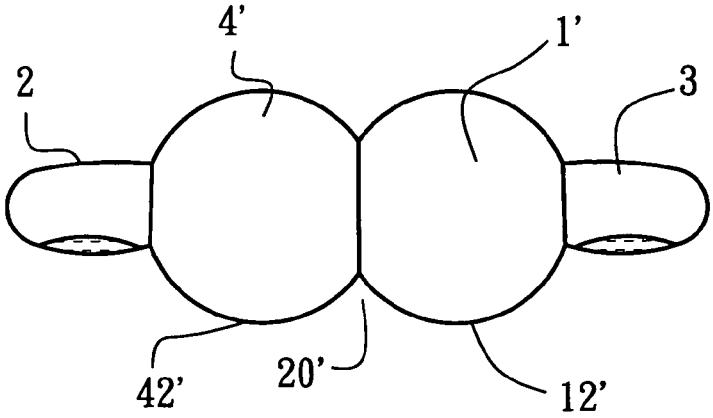
FIG. 9 is a schematic front view of the second preferred embodiment.

Referring to FIGS. 8 and 9, the second preferred embodiment of an inflatable floating device according to the present invention is shown to be similar to the first preferred embodiment. However, in this embodiment, the inflatable body 100' includes third and fourth inflatable portions 1', 4' between the first and second inflatable portions 2, 3. The bottom walls 12', 42' of the third and four thin flatable portions 1', 4' cooperate to define an additional indentation 20'. The advancing of the inflatable body 100' is additionally enhanced through this configuration.

Figure 10:
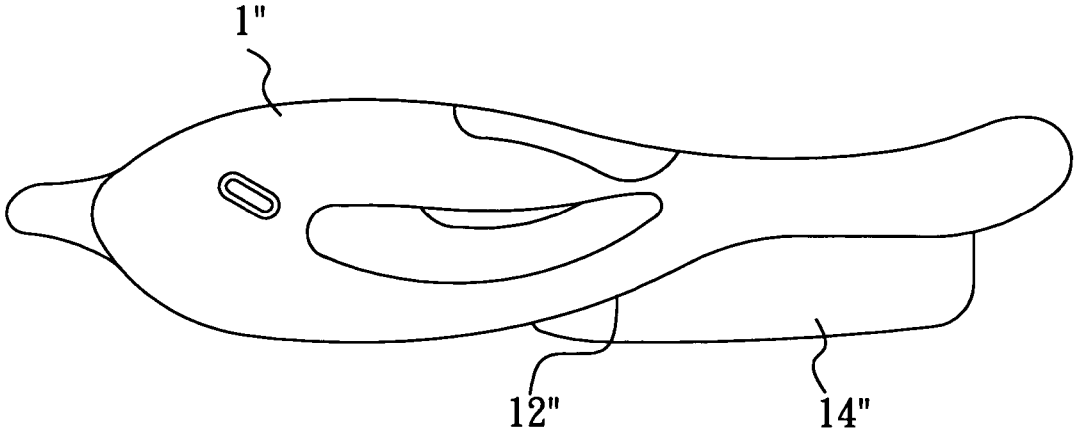
FIG. 10 is a schematic side view of the third preferred embodiment of an inflatable floating device according to the present invention.
Figure 11:
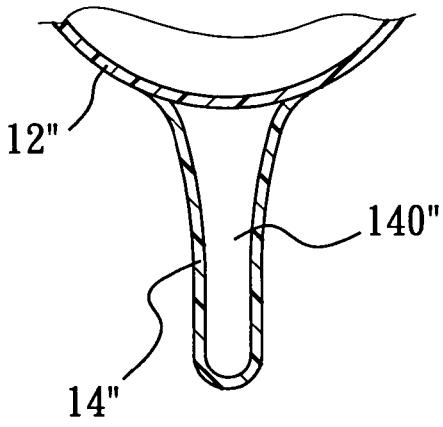
FIG. 11 is a fragmentary schematic rear view of a rudder portion of the third preferred embodiment.

According to the present invention, the rudder portion 14 should not be limited to hard materials, such as wood and plastic steel. As shown in FIGS. 10 and 11, the third preferred embodiment of an inflatable floating device according to the present invention includes a rudder portion 14" which is formed integrally with the third inflatable portion 1". The rudder portion 14" is connected to the third bottom wall 12" of the third inflatable portion 1", and has an air chamber 140". When the rudder portion 14" is inflated, it projects downwardly from the third bottom wall 12".

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An inflatable floating device comprising:

(a) an inflatable body including front and rear ends, wherein said inflatable body further includes first and second inflatable portions, which have respective air chambers and which extend from said front end to said rear end, said first and second inflatable portions including respective first and second bottom walls and respective first and second top walls, each of said first and second bottom walls having a front head portion, a rear tail portion, and a middle portion between said front head and rear tail portions, each of said first and second bottom walls extending upwardly and curvedly from said middle portion to said front head and rear tail portions, (b) a hand grip disposed on a top side of said inflatable body adjacent to said front end, (c) a rudder portion projecting downwardly from a bottom side of said inflatable body, said bottom side of said inflatable body being convexed downwardly between said front and rear ends, (d) a counterweight disposed in said inflatable body adjacent to said bottom side, and (e) two leg support parts disposed on said top side of said inflatable body.

2. The inflatable floating device as claimed in claim 1, wherein said first and second bottom walls define therebetween an indentation that extends substantially in a front-to-rear direction.

3. The inflatable floating device as claimed in claim 1, wherein said inflatable body further includes a third inflatable portion which is disposed between and connected to said first and second inflatable portions, said third inflatable portion having a third top wall and a third bottom wall which includes a front head portion, a rear tail portion and a middle portion between said front head and rear tail portions of said third inflatable portion, said hand grip being connected to said third top wall adjacent to said front head portion of said third inflatable portion.

4. The inflatable floating device as claimed in claim 3, wherein said third bottom wall cooperates with each of said first and second bottom walls to define an indentation, said indentation extending substantially in a front-to-rear direction.

5. The inflatable floating device as claimed in claim 3, wherein said rudder portion projects downwardly from said third bottom wall, and said counterweight is disposed in each of said first and second inflatable portions adjacent to said first and second bottom walls.

6. The inflatable floating device as claimed in claim 3, wherein said third bottom wall has a fastening unit, said rudder portion being connected to said third bottom wall through said fastening unit.

7. An inflatable floating device comprising:

(a) an inflatable body including front and rear ends, (b) a hand grip disposed on a top side of said inflatable body adjacent to said front end, (c) a rudder portion projecting downwardly from a bottom side of said inflatable body, said bottom side of said inflatable body being convexed downwardly between said front and rear ends, (d) a counterweight disposed in said inflatable body adjacent to said bottom side, and (e) two leg support parts disposed on said top side of said inflatable body, wherein said rudder portion includes a rudder plate that extends in a front-to-rear direction, and a tail wing pivotally connected to a rear end of said rudder plate.

8. The inflatable floating device as claimed in claim 7, wherein said rudder plate has a connecting member at said rear end of said rudder plate, said connecting member being substantially U-shaped, and having spaced-apart upper and lower arms, and a pivot plate extending between and bridging said upper and lower arms, said tail wing having a front pivot portion pivoted to said pivot plate and being swingable upwardly and downwardly.

9. The inflatable floating device as claimed in claim 8, wherein said front pivot portion is movable between said upper and lower arms, said upper and lower arms respectively having upper and lower rear edges to contact said front pivot portion so as to limit movement of said front pivot portion.

10. The inflatable floating device as claimed in claim 1, wherein each of said first and second leg support parts is provided with an anti-slip member.

11. The inflatable floating device as claimed in claim 3, wherein said third inflatable portion projects forwardly from said first and second front head portions.

12. The inflatable floating device as claimed in claim 1, wherein said inflatable body has a width in a direction transverse to a front-to-rear direction, said width being reduced toward said front end from a portion of said inflatable body between said front and rear ends.

* * * * *